US012679611B2

(12) United States Patent
Fisch

(10) Patent No.: US 12,679,611 B2
(45) Date of Patent: Jul. 14, 2026

(54) VENTED DISPENSING LINER

(71) Applicant: Selig Sealing Products, Inc., Forrest, IL (US)

(72) Inventor: Adam Jeffery Fisch, Dorr, MI (US)

(73) Assignee: Selig Sealing Products, Inc., Forrest, IL (US)

( * ) Notice: Subject to any disclaimer, the term of this patent is extended or adjusted under 35 U.S.C. 154(b) by 0 days.

(21) Appl. No.: 18/684,505

(22) PCT Filed: Aug. 17, 2022

(86) PCT No.: PCT/US2022/040599
§ 371 (c)(1),
(2) Date: Feb. 16, 2024

(87) PCT Pub. No.: WO2023/027925
PCT Pub. Date: Mar. 2, 2023

(65) Prior Publication Data

US 2025/0121994 A1 Apr. 17, 2025

Related U.S. Application Data

(60) Provisional application No. 63/237,418, filed on Aug. 26, 2021.

(51) Int. Cl.
*B65D 51/16* (2006.01)
*B65D 53/08* (2006.01)

(52) U.S. Cl.
CPC ..... *B65D 51/1633* (2013.01); *B65D 53/08* (2013.01)

(58) Field of Classification Search
CPC ..... B65D 51/1633; B65D 53/08; B65D 2543/00046; A47G 19/2272
See application file for complete search history.

(56) References Cited

U.S. PATENT DOCUMENTS 2,692,659 A 10/1954 Tack
3,682,366 A 8/1972 Chung
(Continued)

FOREIGN PATENT DOCUMENTS

CN 202765500 U 3/2013
CN 210762082 U 6/2020
(Continued)

OTHER PUBLICATIONS

European Patent Office, Extended European Search Report for European Patent Application No. 22 861 902.9 dated Nov. 27, 2024, 11 pages.
(Continued)

*Primary Examiner* — James N Smalley
(74) *Attorney, Agent, or Firm* — Fitch, Even, Tabin & Flannery, LLP

(57) ABSTRACT

A vented sealing member is provided for sealing to a rim of a container. The vented sealing member may provide for an exchange of fluid, such as gas, between an interior space of the container and the ambient atmosphere. This exchange may be necessary as pressure internal to the container may increase and/or decrease at various times, such as after manufacture and shipment. The vented sealing member is also configured to dispense the contents of the container when an upper member, such as a tabbed member, is removed from the sealing member.

18 Claims, 10 Drawing Sheets

(56) References Cited

U.S. PATENT DOCUMENTS

| | | | | |
|---|---|---|---|---|
| 4,020,969 | A | 5/1977 | Ando | |
| 4,174,784 | A | 11/1979 | Hartung | |
| 4,445,620 | A | 5/1984 | Brochman | |
| 4,564,121 | A | 1/1986 | Brochman | |
| 4,595,114 | A | 6/1986 | Lu | |
| 4,637,919 | A | 1/1987 | Ryder | |
| 4,765,499 | A | 8/1988 | Von Reis | |
| 4,771,937 | A | 9/1988 | Kamada | |
| 4,790,445 | A | 12/1988 | Shibata | |
| 4,793,509 | A | 12/1988 | Coleman | |
| 4,960,216 | A | 10/1990 | Giles | |
| 5,004,111 | A | 4/1991 | McCarthy | |
| 5,077,050 | A | 12/1991 | Wall | |
| 5,125,529 | A | 6/1992 | Torterotot | |
| 5,186,344 | A | 2/1993 | Cook | |
| 5,197,618 | A | 3/1993 | Goth | |
| 5,265,745 | A | 11/1993 | Pereyra | |
| 5,341,948 | A | 8/1994 | Gaeta | |
| 5,513,781 | A | 5/1996 | Ullrich | |
| 5,649,639 | A | 7/1997 | Dolvet | |
| 5,727,707 | A | 3/1998 | Wickland | |
| 5,730,306 | A | 3/1998 | Costa | |
| 5,853,096 | A | 12/1998 | Bartur | |
| 5,882,454 | A | 3/1999 | Baginski | |
| 5,911,332 | A | 6/1999 | Wickland | |
| 5,988,414 | A | 11/1999 | Schwarz | |
| 6,012,596 | A | 1/2000 | Oglesbee | |
| 6,043,097 | A | 3/2000 | Dumitrescu | |
| 6,196,409 | B1 | 3/2001 | Lake | |
| 6,395,170 | B1 | 5/2002 | Hughes | |
| 6,454,137 | B1 | 9/2002 | Sturk | |
| 6,565,743 | B1 | 5/2003 | Poirier | |
| 6,712,887 | B2 | 3/2004 | Ueki | |
| 6,983,857 | B2 | 1/2006 | Miller | |
| 7,291,208 | B2 | 11/2007 | Dauber | |
| 7,308,919 | B1 | 12/2007 | Zavala | |
| 7,703,630 | B2 | 4/2010 | Degutis | |
| 7,782,212 | B2 | 8/2010 | Burns | |
| 7,798,359 | B1 | 9/2010 | Marsella | |
| 7,882,991 | B2 | 2/2011 | Schechter | |
| 8,263,016 | B2 | 9/2012 | Kanner | |
| 8,568,503 | B2 | 10/2013 | Sasaki | |
| 8,758,488 | B1 | 6/2014 | Wickland | |
| 9,457,940 | B2 | 10/2016 | Grell | |
| 9,469,456 | B2 | 10/2016 | Grell | |
| 9,708,110 | B2 | 7/2017 | Walsh | |
| 9,845,181 | B2 | 12/2017 | Abraham | |
| 9,944,440 | B2 | 4/2018 | Abraham | |
| 10,016,079 | B2 * | 7/2018 | Chiang | B65D 43/02 |
| 10,264,903 | B2 | 4/2019 | Fisch | |
| 10,351,320 | B2 | 7/2019 | Fisch | |
| 10,377,539 | B2 | 8/2019 | Fisch | |
| 10,384,840 | B2 | 8/2019 | Fisch | |
| 10,710,782 | B2 | 7/2020 | Fisch | |
| 10,926,926 | B2 | 2/2021 | Ko | |
| 10,934,065 | B2 | 3/2021 | Fisch | |
| 10,968,016 | B2 | 4/2021 | Shi | |
| 11,155,393 | B2 | 10/2021 | Fisch | |
| 11,401,087 | B2 | 8/2022 | Kleyn | |
| 11,738,917 | B2 | 8/2023 | Fisch | |
| 12,420,493 | B2 | 9/2025 | Shah | |
| 2002/0036176 | A1 | 3/2002 | Hughes | |
| 2004/0262253 | A1 | 12/2004 | Miller | |
| 2007/0108212 | A1 | 5/2007 | Nelson | |
| 2008/0035652 | A1 | 2/2008 | Lusareta | |
| 2008/0146136 | A1 | 6/2008 | Degutis | |
| 2009/0057326 | A1 | 3/2009 | Opitz | |
| 2009/0065518 | A1 * | 3/2009 | Carnevali | B65D 47/06 220/711 |
| 2009/0200308 | A1 | 8/2009 | Walsh | |
| 2009/0230078 | A1 | 9/2009 | Walsh | |
| 2009/0283545 | A1 | 11/2009 | Kimball | |
| 2010/0071319 | A1 | 3/2010 | Raniwala | |
| 2010/0233049 | A1 | 9/2010 | Kanner | |
| 2011/0168715 | A1 | 7/2011 | Erdmann | |
| 2012/0017766 | A1 | 1/2012 | Anson | |
| 2012/0060693 | A1 | 3/2012 | Sasaki | |
| 2012/0121764 | A1 | 5/2012 | Lai | |
| 2012/0192728 | A1 | 8/2012 | Huang | |
| 2012/0261283 | A1 | 10/2012 | Anson | |
| 2013/0032566 | A1 | 2/2013 | Lee | |
| 2013/0240531 | A1 | 9/2013 | Abraham | |
| 2014/0151386 | A1 | 6/2014 | Alioto | |
| 2014/0262894 | A1 | 9/2014 | Jansen | |
| 2014/0272018 | A1 | 9/2014 | Koller | |
| 2015/0210438 | A1 | 7/2015 | Ledun | |
| 2016/0046414 | A1 | 2/2016 | Grell | |
| 2016/0046422 | A1 | 2/2016 | Grell | |
| 2017/0007051 | A1 | 1/2017 | Fisch | |
| 2017/0055742 | A1 * | 3/2017 | Oakes | A47G 19/2272 |
| 2017/0081093 | A1 | 3/2017 | Fisch | |
| 2017/0081094 | A1 | 3/2017 | Fisch | |
| 2018/0134458 | A1 | 5/2018 | Lloyd | |
| 2018/0134461 | A1 | 5/2018 | Fisch | |
| 2018/0186122 | A1 | 7/2018 | Bourgeois | |
| 2019/0106252 | A1 | 4/2019 | Fisch | |
| 2020/0047959 | A1 | 2/2020 | Kleyn | |
| 2020/0277114 | A1 | 9/2020 | Shi | |
| 2022/0324623 | A1 * | 10/2022 | Baur | B65D 51/185 |

FOREIGN PATENT DOCUMENTS

| | | | | |
|---|---|---|---|---|
| DE | 102020006823 | A1 * | 5/2022 | B65D 43/0212 |
| EP | 2692659 | A1 | 2/2014 | |
| EP | 4194361 | | 6/2023 | |
| WO | 9702994 | A1 | 1/1997 | |
| WO | 2016149297 | A1 | 9/2016 | |

OTHER PUBLICATIONS

Darcy's Law—Wikipedia.org, retrieved from URL https://en.wikipedia.org/wiki/Darcy's_law (Year: 2020).

Gore—Materials Technology, published online in Dec. 2011 (per date stamp in lower-right corner of p. 2) , retrieved from URL https://www.gore.com/sites/g/files/ypyipe116/files/2016-04/PTV-TechInfo-Hydrophobic-Oleophobic-US.pdf (Year: 2011).

Hydrophobic—definition by Merriam-Webster, retrieved from URL https://www.merriam-webster.com/dictionary/hydrophobic (Year: 2020).

Single—definition by Merriam-Webster, retrieved from URL https://www.merriam-webster.com/dictionary/single (Year: 2020).

Patent Cooperation Treaty, International Search Report and Written Opinion of the International Search Authority for International Application PCT/US2022/040599 dated Nov. 15, 2022, 24 pages.

* cited by examiner

VENTED DISPENSING LINER

CROSS-REFERENCE TO RELATED APPLICATIONS

This application is a U.S. national phase application filed under 35 U.S.C. § 371 of International Application Number PCT/US2022/040599, filed Aug. 17, 2022, designating the United States, which claims priority from Provisional Application No. 63/237,418, filed Aug. 26, 2021, which is hereby incorporated herein by reference in its entirety.

FIELD

The disclosure relates to sealing members for sealing the mouth of a container, and more particularly, to sealing members having a vent and a dispensing opening.

BACKGROUND

It is often desirable to seal the opening of a container using a seal, sealing member, or inner seal. Often a cap or other closure is screwed or placed over the container opening capturing the sealing member therein. In use, a consumer typically removes the cap or other closure to gain access to the sealing member and then removes or otherwise peels the seal from the container in order to dispense or gain access to its contents. In some forms, the user may puncture the seal to gain access to the interior contents of the container.

Initial attempts at sealing a container opening utilized an induction- or conduction-type inner seal covering the container's opening where the seal generally conformed to the shape of the opening such that a circular container opening was sealed with a round disk approximately the same size as the opening. These prior seals commonly had a lower heat activated sealing layer to secure a periphery of the seal to a rim or other upper surface surrounding the container's opening. Upon exposing the seal to heat, the lower layer bonded to the container's rim. In many cases, these seals included a foil layer capable of forming induction heat to activate the lower heat seal layer.

However, problems still arise with sealing members when the contents of the container require pressure equalization. Sealed gas-tight containers require venting when gas pressure must be equalized between the interior and exterior of the container. Without venting, a flexible gas-tight container will bloat, leak, and possibly burst when the interior pressure exceeds the exterior pressure. Bloating can occur when the contents of the container generates gasses or heat by chemical reaction, for example when the contents include a peroxide-based toothpaste. Bloating can also occur when the container is stored in a heated environment. Similarly, an unvented flexible gas-tight container will collapse when the internal pressure is reduced, for example when atmospheric oxygen is scavenged by one of the ingredients housed in the container. Some modes of transportation put a container at risk of both bursting and collapse. During transport through mountains and valleys, for example, a container is subjected to pressures that can rise above and drop below sea level pressure. Rigid gas-tight containers, such as glass containers, are susceptible to bursting or imploding if the internal and external pressures become sufficiently discrepant.

One way to equalize pressure is to provide a filter vent in the cap, lid, or other closure of a container. Filter vents generally include a gas-permeable filter, or other gas permeable microporous medium, which is interposed between the interior of the container and a vent aperture. The filter vent permits gases to diffuse in and out of the interior of the container, via the vent aperture, while excluding particulates larger than a threshold size, as well as liquids of a particular range of hydrophobicity.

However, filter caps have other drawbacks. The pores of the filter are susceptible to being filled and clogged by the contents of the container. Further, the filter can make it difficult to puncture the seal. This may be a result of the added layers of the filter material, the filter material itself, and/or the adhesives used to secure the filter to the sealing member. This can be especially problematic when a user desires to precisely dispense the contents of the container if the sealing member is pierced and jagged remnants of the sealing member and filter remain on the container.

Further, depending on the properties of the contents of the container, the contents themselves can easily block, clog, or otherwise render the vent deficient. For example, materials with high viscosity, high tackiness, and other similar properties are more prone to clogging vents. Such materials can come into contact with the vent, such as during manufacture, transport, and the like, such that once they come into contact, they are not easily removed from thed vent.

It is also often desirable to have a sealing member that is suitable for dispensing the contents of the container. However, it has been difficult to achieve the combination of dispensing and venting in a single sealing member. Providing a suitable vent may not be suitable for dispensing the contents and vice versa.

SUMMARY

According to some forms, a vented sealing member for sealing to a rim of a container is provided. The sealing member includes a support member, a vent layer, and an upper member. The support member has at least one layer and defines a vent opening and a dispensing opening. Each of the vent opening and dispensing opening extends from a lower surface to an upper surface through the support member. The vent layer is positioned about the vent opening on at least one of the lower surface and the upper surface. The upper member is positioned at the upper surface of the support member and partially coupled thereto to provide a coupled portion and a free portion forming a gripping tab for separating the upper member from the support member. The coupled portion covers the dispensing opening at the upper surface of the support member.

In some forms, a laminate for forming a vented sealing member is provided. The laminate includes a support member, a vent layer, and an upper member. The support member has at least one layer and defines a vent opening and a dispensing opening. Each of the vent opening and dispensing opening extends from a lower surface to an upper surface through the support member. The vent layer is positioned about the vent opening on at least one of the lower surface and the upper surface. The upper member is positioned at the upper surface of the support member and partially coupled thereto to provide a coupled portion and a free portion forming a gripping tab for separating the upper member from the support member. The coupled portion covers the dispensing opening at the upper surface of the support member.

In accordance with some forms, a method for forming a vented sealing member is provided. The method includes the steps of providing a support member having at least one layer, the support member having a lower surface and an upper surface, forming a vent opening extending from the lower surface to the upper surface through the support member, forming a dispensing opening extending from the lower surface to the upper surface through the support member, positioning a vent layer at the vent opening and coupling the vent layer to one of the lower surface and the upper surface of the support member, and securing an upper member on the upper surface of the support member, the upper member covering the dispensing opening.

According to some forms, the vent layer is coupled to the upper surface of the support member.

In accordance with some forms, the vent layer is coupled to the lower surface of the support member.

In some forms, the support member is a laminate comprising a plurality of layers.

According to some forms, the support member comprises at least one of a polymer film, a polymer foam, a metal foil, a pulp material, paper, and combinations thereof.

In accordance with some forms, the upper member is a laminate comprising a plurality of layers.

In some forms, the vent layer comprises expanded polytetrafluoroethylene.

According to some forms, the vent opening has a diameter of about 0.005 to about 0.250 inches.

In accordance with some forms, the dispensing opening has a diameter of about 0.0625 to about 0.5 inches In some forms, the sealing member further includes a screen covering the dispensing opening.

According to some forms, the sealing member includes a surface area and the upper member extends across the surface area.

In accordance with some forms, the sealing member includes a surface area and the upper member extends across less than the surface area.

In some forms, the vented sealing member further includes a plurality of dispensing openings.

According to some forms, the vented sealing member further includes a cap liner positioned above the upper member and being removably secured to the sealing member.

Further, in some forms, the present application proceeds contrary to conventional wisdom. Prior venting caps and seals would traditionally increase the size of the vent to minimize the impact of the contents on the vent function. It was previously thought that by increasing the surface area of the vent, the likelihood of the vent being entirely blocked would decrease. Similarly, prior systems incorporated the vent material or layer on an underside of the seal and oftentimes also included a cover over a portion of the vent. In this regard, it was previously thought that the cover helped prevent the contents of the container from contacting the vent.

Some forms of present concept, on the other hand, proceeds contrary to this conventional wisdom and can achieve improved performance compared to prior venting systems. In one form, the vent material is positioned on an opposite side of the sealing member and/or support member from the contents of the container. Further, the sealing member and/or support member can be used to define a vent opening to prevent contact between the contents and the vent material. The vent opening can be configured to be small, especially compared to many prior vent openings. By doing this, pressure can be concentrated on a much smaller surface area to clear any clogs from the vent opening and/or vent material. Further, a separate dispensing opening can be provided that is suitably sized for dispensing the contents of the container.

These and other aspects may be understood more readily from the following description and the appended drawings.

DETAILED DESCRIPTION

Figure 1:
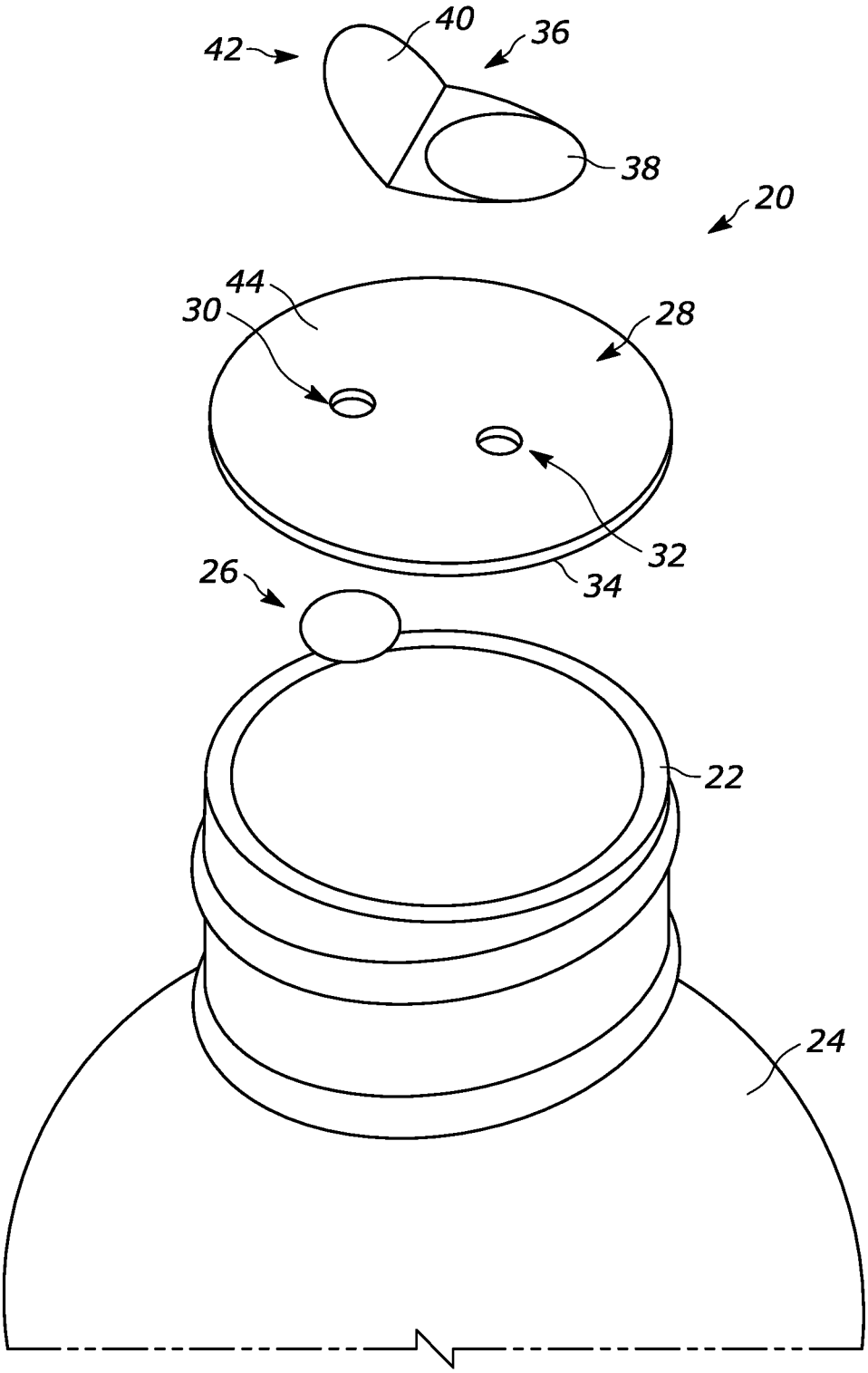
FIG. 1 is an exploded view of one form of a vented sealing member.

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

A sealing member for sealing to a container is provided herein. In further forms, a tabbed sealing member for a container is described herein containing an upper portion having a pull tab bonded to a lower laminate portion capable of being sealed to a container's mouth or opening. In other forms, the various sealing members may be sealed via a pressure sensitive sealant layer. It should also be appreciated that the sealing member may have an external tab, extending outward beyond the lid of the container and/or may be a tab-free sealing member.

For simplicity, this disclosure generally may refer to a container or bottle, but the sealing members herein may be applied to any type of container, bottle, package or other apparatus having a rim or mouth surrounding an access opening to an internal cavity. In this disclosure, reference to upper and lower surfaces and layers of the components of the sealing member refers to an orientation of the components as generally depicted in figures and when the sealing member is in use with a container in an upright position and having an opening at the top of the container. Different approaches to the sealing member will first be generally described, and then more specifics of the various constructions and materials will be explained thereafter.

It will be appreciated that the sealing members described herein, in some cases, function in both a one-piece or two-piece sealing member configuration. A one-piece sealing member generally includes just the sealing member bonded to a container rim. A cap or closure may be also used therewith. A two-piece sealing member includes the sealing member and a liner or cap liner. In some forms, the sealing member and liner are separate component adjacent one another, but not adhered or otherwise temporarily bonded to one another. In the latter construction, the sealing member is bonded to a container's rim, and the liner is configured to separate from the sealing member during heating to be retained in a cap or other closure used on the container. In one form of a two-piece construction, a wax layer, for example, may be used to temporarily bond the sealing member to a liner. Other types of releasable layers may also be used to provide a temporary bond between the seal and liner, but the releasable layers are generally heat activated.

It should be appreciated that the vented sealing members described herein may be used in a variety of different types of sealing members. For example, the vented sealing members may take the form of an induction sealing member, a conduction sealing member, a pressure sensitive adhesive sealing member, as well as other types of sealing members. The vented sealing members may also be in the form of a foam liner or sealing member, a flexible film, and the like. The vented sealing members may also include one or more tabs for removal of the sealing member.

It should also be appreciated that the vented sealing members described herein may be used in a variety of configurations with a variety of different combinations of layers. For example, the sealing members may include polymer foams, films, coextrusions, foils, membranes, adhesives, paper, cardboard, as well as other materials that are used in sealing members. The thicknesses and positions of each of the layers may be modified as desired for a particular application.

As shown in FIG. 1, a vented sealing member 20 is shown installed on a rim 22 of a container 24. The vented sealing member 20 includes a vent material 26 installed on a support member 28. The support member also includes a vent opening 30 and a dispensing opening 32. The vent opening 30 is generally configured to allow fluids, such as gas, to be exchanged between the inside and outside of the container, such as during manufacturing and shipping. The dispensing opening 32 is configured to permit dispensing of the contents of the container when operated by a user.

In the form shown in FIG. 1, the vent material 26 is installed on a lower side 34 of the support member 28. The vent material may be a single vent layer, may include a vent layer and a carrier or support and the like. In some forms, the vent material includes a vent layer and a silicon layer that acts as a carrier to support the vent layer adjacent the support member 28. The sealing member 20 also includes an upper member 36 having a coupled portion 38 and a free portion 40 forming a gripping tab 42. As shown in FIG. 1, the upper member 36 is coupled to the support member on an upper surface 44. In some forms, the upper member 36 is configured such that a user grasps the tab 42 to remove the upper member 36 from the support member 28.

Figure 2:
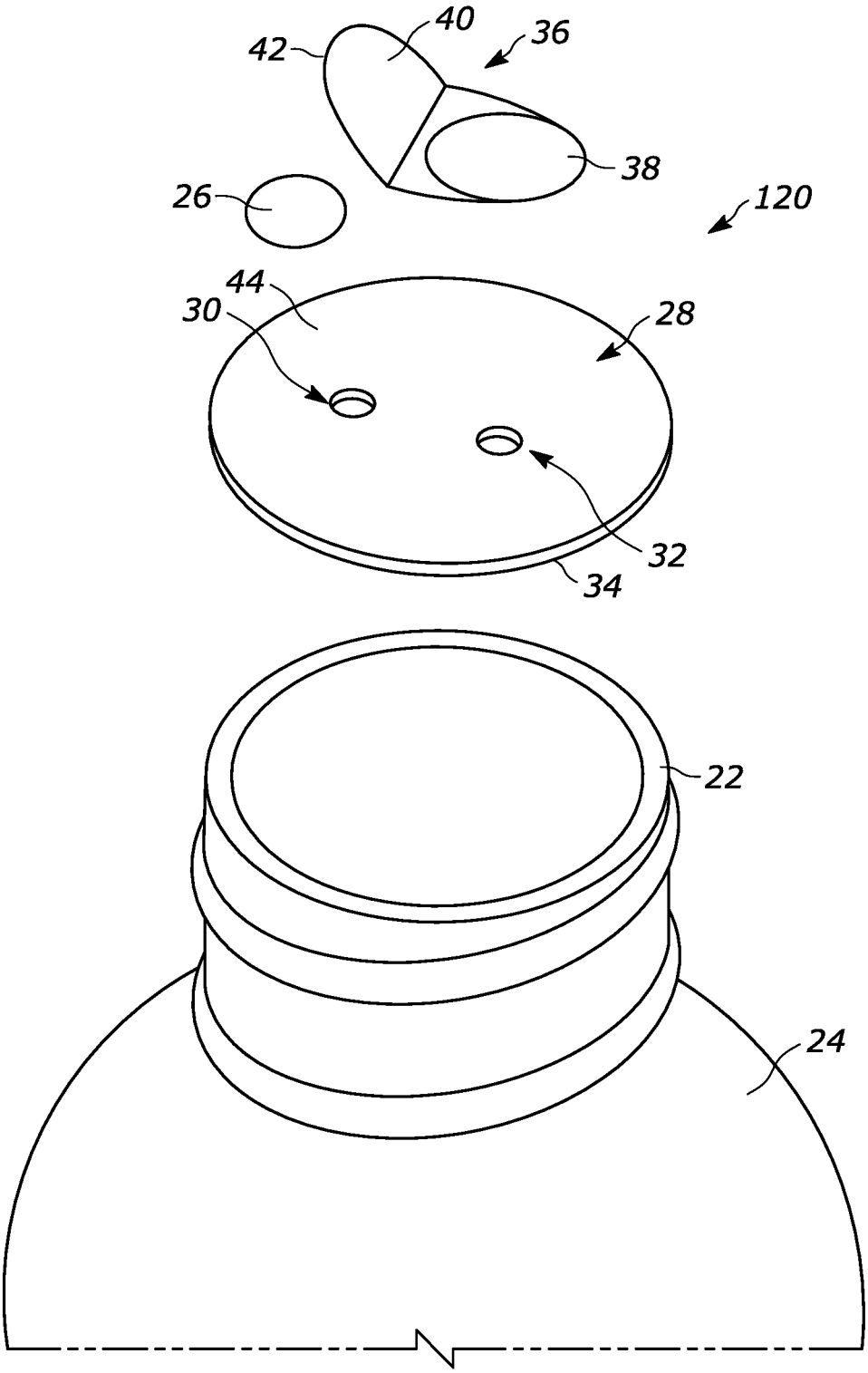
FIG. 2 is an exploded view of another form of vented sealing member.

Another form of a vented sealing member 120 is shown in FIG. 2. Sealing member 120 generally includes many similar features as those discussed above and includes similar reference numbers. Sealing member 120 also includes vent material 26 positioned on the upper surface 44 of the support member 28 instead of the lower side 34, as shown in FIG. 1.

Figure 3:
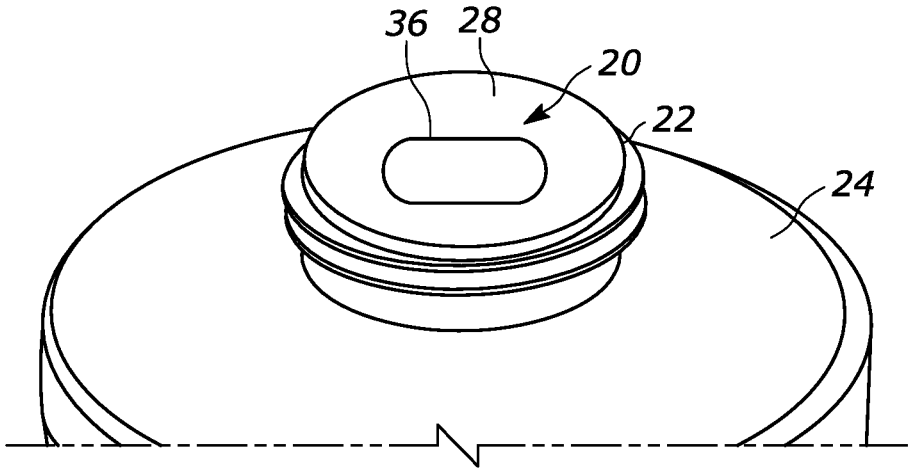
FIG. 3 is a perspective view of a vented sealing member with a gripping tab.
Figure 4:
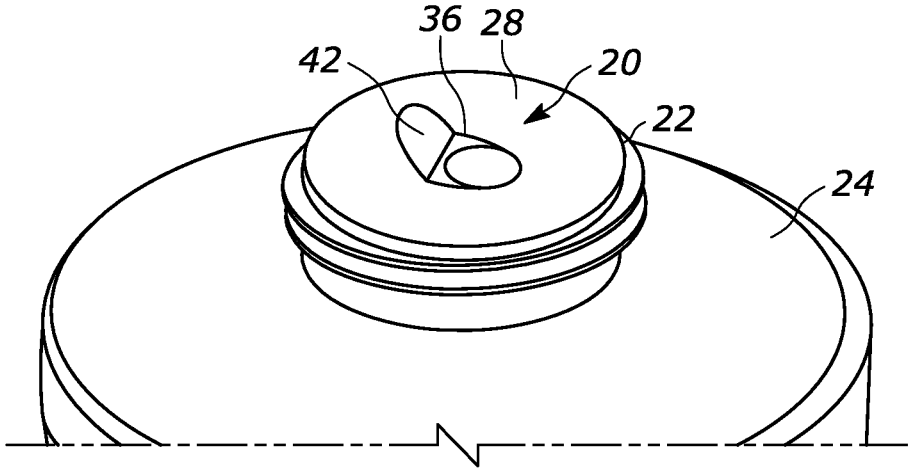
FIG. 4 is a perspective view of the vented sealing member of FIG. 3 with the gripping tab extended upward.

Turning now to FIGS. 3 and 4, sealing member 20 is shown as installed on the rim 22 of the container 24. As shown in FIG. 3, the upper member 36 is generally flat against the support member 28. However, when a user engages the upper member 36, the tab 42 can extend upward and be grasped by the user, such as shown in FIG. 4.

Figure 5:
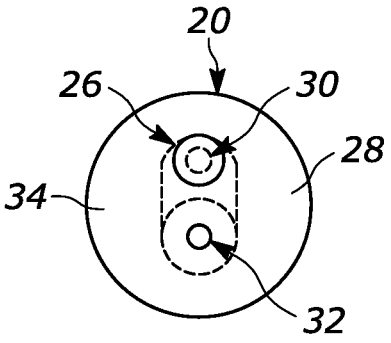
FIG. 5 is a bottom view of a vented sealing member with a lower vent material layer.
Figure 6:
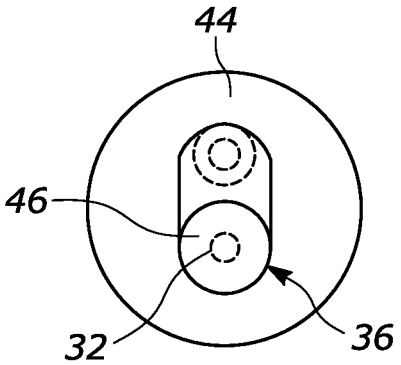
FIG. 6 is a top view of the vented sealing member of FIG. 5.

It should be appreciated that certain structures in FIGS. 5 and 6 are shown in dashed lines and are actually on the opposite side in the presented view. However, the dashed lines are presented to show an approximate location of the structures on the opposing side. FIG. 5 is a bottom view of sealing member 20 which shows vent material 26 thereon and dispensing opening 32. In FIG. 6, which is a top view, shows the upper member 36 secured to upper surface 44. While dispensing opening 32 is generally noted in this view, it would not be visible as it is covered by the upper member 36. Further, upper member 36 is secured to the upper surface in an area about the dispensing opening 32, such as represented by circle 46. While shown as a circle, the upper member 36 can be coupled to the upper surface 44 in other areas. In some forms, the upper member 36 is coupled via adhesive, heat staking, welding, and the like.

Figure 7:
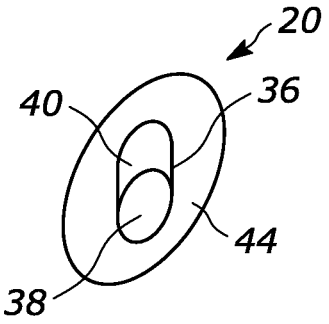
FIG. 7 is a top perspective view of the vented sealing member of FIG. 5.
Figure 8:
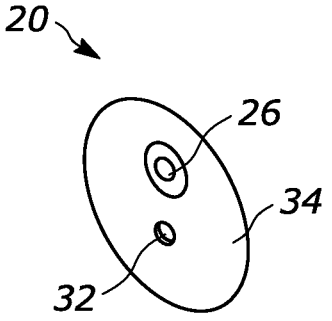
FIG. 8 is a bottom perspective view of the vented sealing member of FIG. 5.

Top and bottom perspective views of the sealing member 20 are also shown in FIGS. 7 and 8. As shown in these forms, the upper member includes a coupled portion that generally seals an area around the dispensing opening. The free portion 40 extends over the vent opening 30, but generally is not adhered in that area. In some forms, the free portion 40 may temporarily be secured to the upper surface 44 around the vent opening 30, but typically is freed during manufacturing or engagement by a user. Regardless, the free portion 40 is not permanently and completely secured around the vent opening 30 as the vent opening 30 and free portion 40 must still permit gas to flow from the inside of the container.

Figure 9:
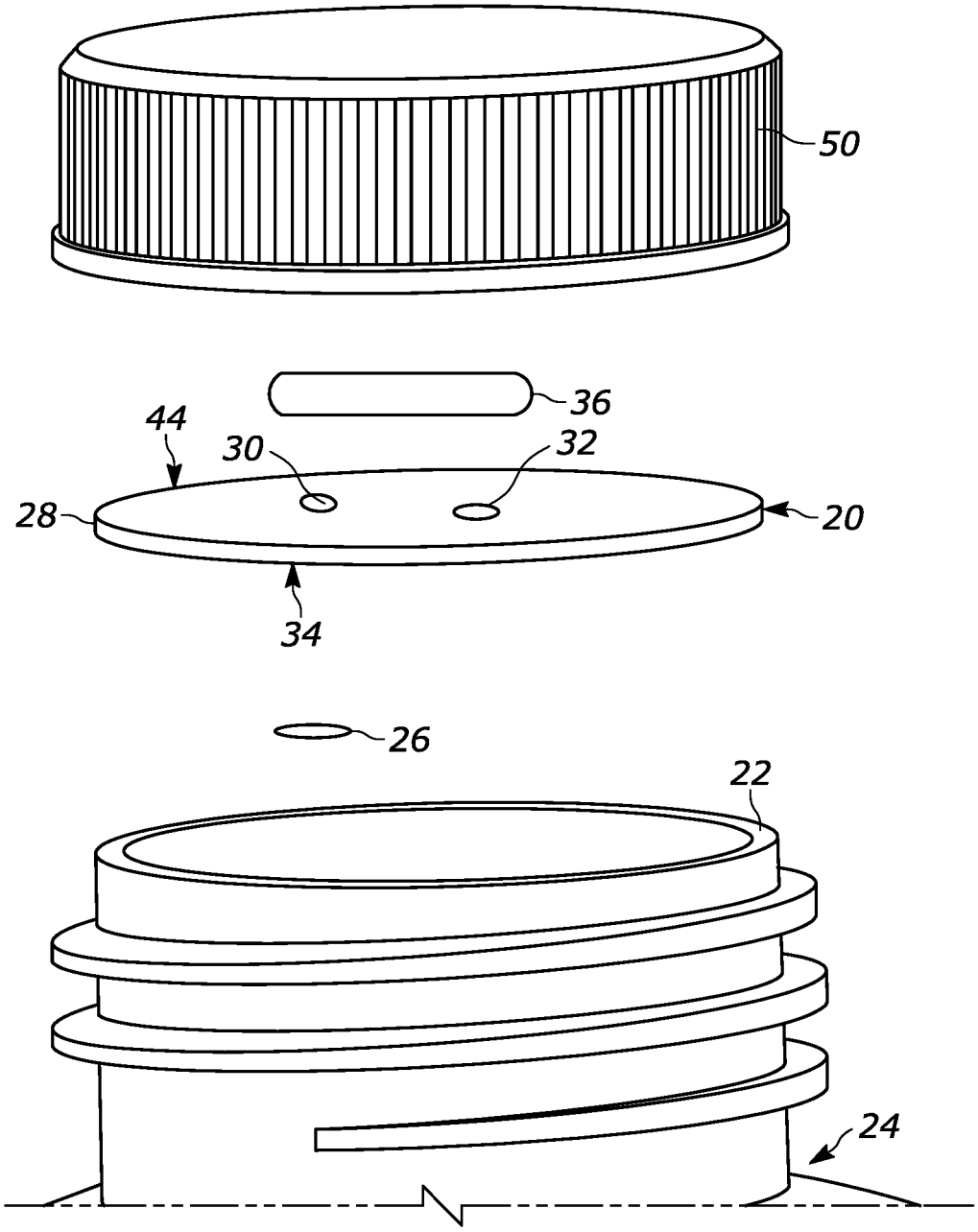
FIG. 9 is an exploded view of a vented sealing member, container, and cap.

A further exploded view of one form of sealing member 20 along with the container 24 and cap 50 is shown in FIG. 9. In this form, the vent material 26 is shown on an underside of the sealing member 20. However, as noted above, it can also be positioned on an upper side either under the tab or outside of the tab.

Figure 10:
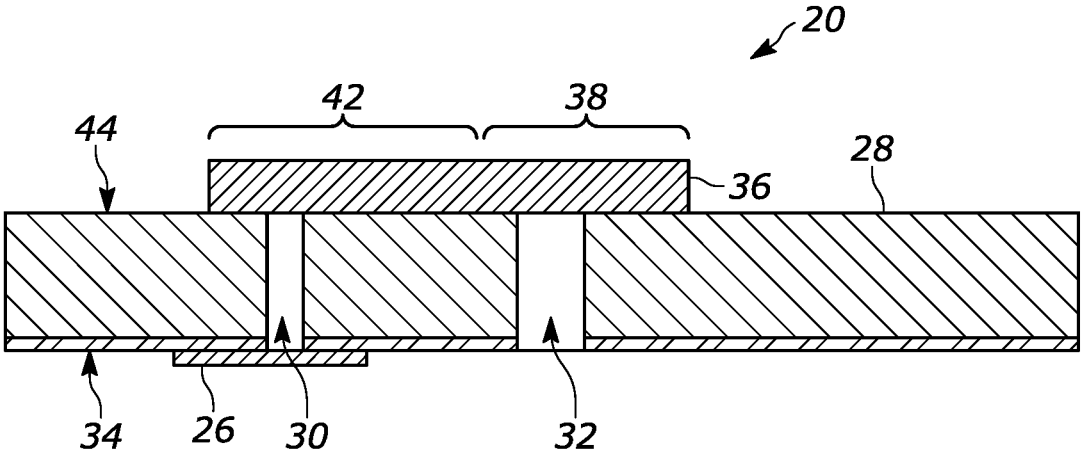
FIG. 10 is cross-sectional view of a vented sealing member with a lower vent material layer.

A cross-sectional view of sealing member 20 is shown in FIG. 10. In this figure, the cross-section has been taken such that the vent opening 30 and dispensing opening 32 are visible. It should be appreciated that the relative thicknesses of the layers in this view are not necessarily to scale and are presented to illustrate the relative position and orientation of the structures. Similar to FIG. 9, the sealing member 20 in FIG. 10 includes the vent material 26 shown on a lower side 34 of the sealing member 20.

Figure 11:
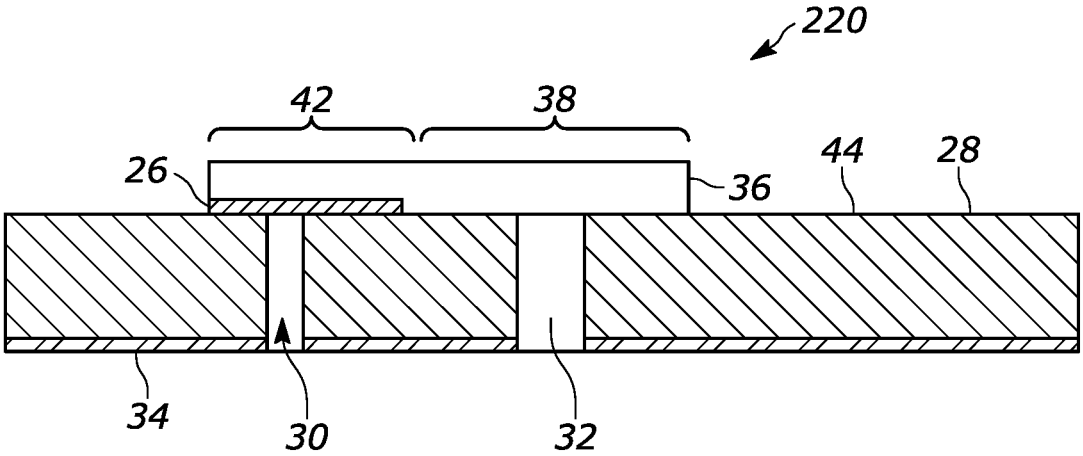
FIG. 11 is a cross-sectional view of a vented sealing member with an upper vent material layer.

A cross-sectional view of sealing member 220 is shown in FIG. 11. Sealing member 220 is similar to sealing member 20 with the primary difference being the location of the vent material 26. In sealing member 220, vent material 26 is positioned at the upper surface 44 of support member 28. Further, as shown in this figure, the vent material is positioned under the tab 42. However, as noted above, the vent material 26 as well as vent opening 30 may be positioned at other areas of the sealing member such that the tab 42 and/or upper member 36 does not cover these features.

Figure 12:
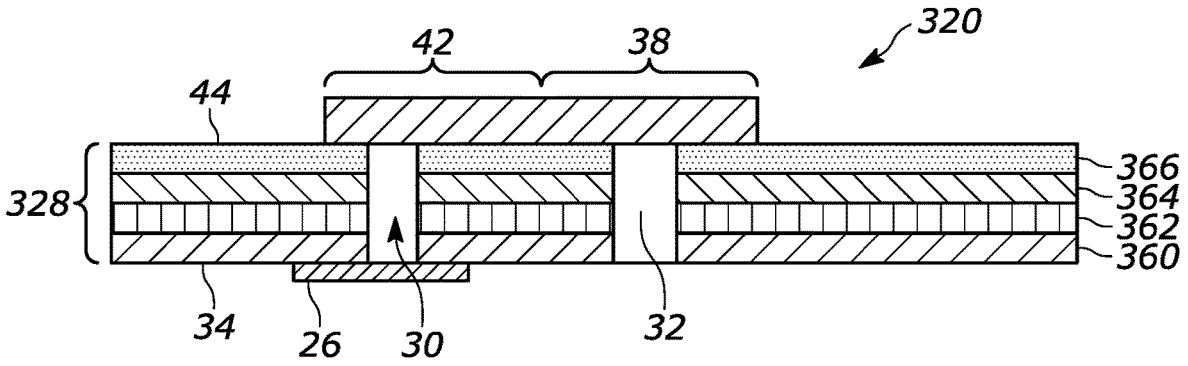
FIG. 12 is a cross-sectional view of a multi-layer vented sealing member with a lower vent material layer.

A cross-sectional view of sealing member 320 is shown in FIG. 12. Sealing member 320 is similar to sealing member 20, but shows multiple layers in support member 328 such that the support member 328 could be considered a laminate. In sealing member 320, the support member 328 includes a sealant layer 360 for adhering the sealing member 320 to a container. Further, sealing member 320 includes an induction layer 362, such as a metal foil layer. The induction layer 362 can be used to provide heat to the sealant layer 360. The sealing member 320 also includes polymer layers, such as polymer foam layer 364 and polymer film layer 366. It should be appreciated that number, types, and relative positions of these layers may be modified as desired.

Figure 13:
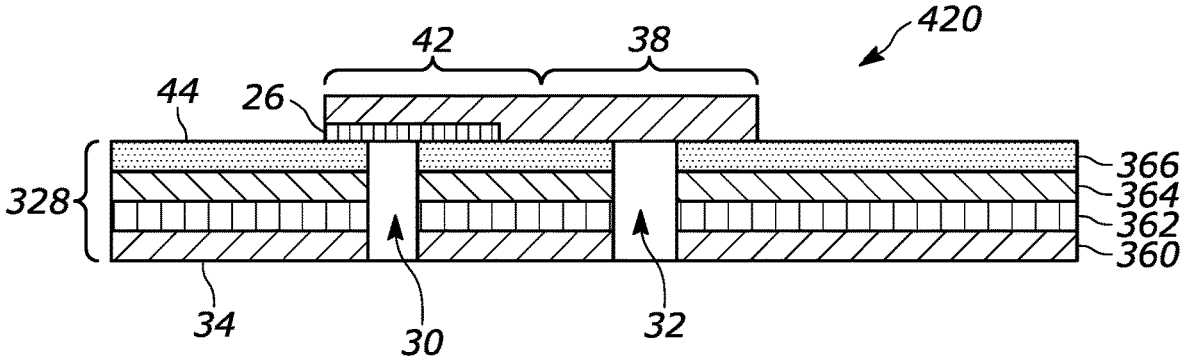
FIG. 13 is a cross-sectional view of a multi-layer vented sealing member with an upper vent material layer.

Yet another sealing member is shown in FIG. 13. As shown in this cross-sectional view, sealing member 420 is similar to sealing member 320 shown in FIG. 12. One primary difference is the location of the vent material 26. In sealing member 420, vent material 26 is positioned at the upper surface 44 of support member 328, contacting the polymer film 366.

Figure 14:
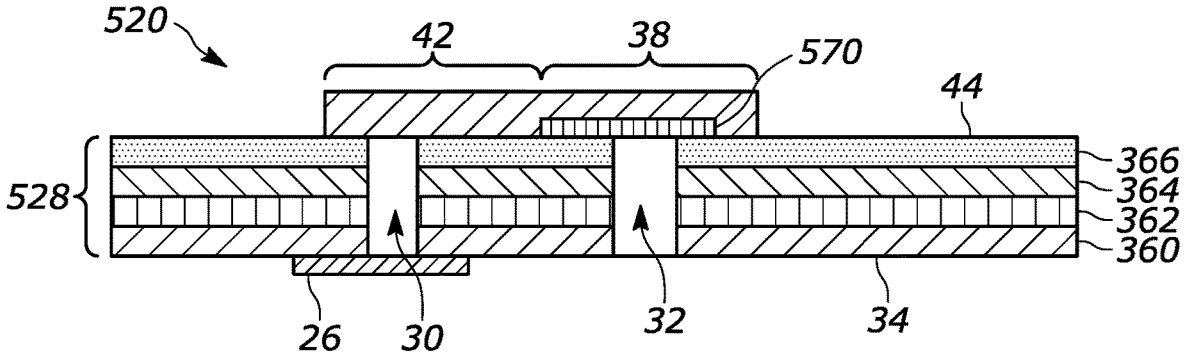
FIG. 14 is a cross-sectional view of a multi-layer vented sealing member with a screen layer at the dispensing opening.

A further form of sealing member is shown in FIG. 14. A cross-section of sealing member 520 is shown, which includes similar features as shown in FIG. 12 for sealing member 320. One notable difference is the inclusion of a screen 570, to help aerate and/or disperse the contents of the container when they are dispensed. The screen 570 is shown on the upper surface 44, but may also be positioned on lower side 34 or between the two surfaces, such as an intermediate layer in support member 528.

Figure 15:
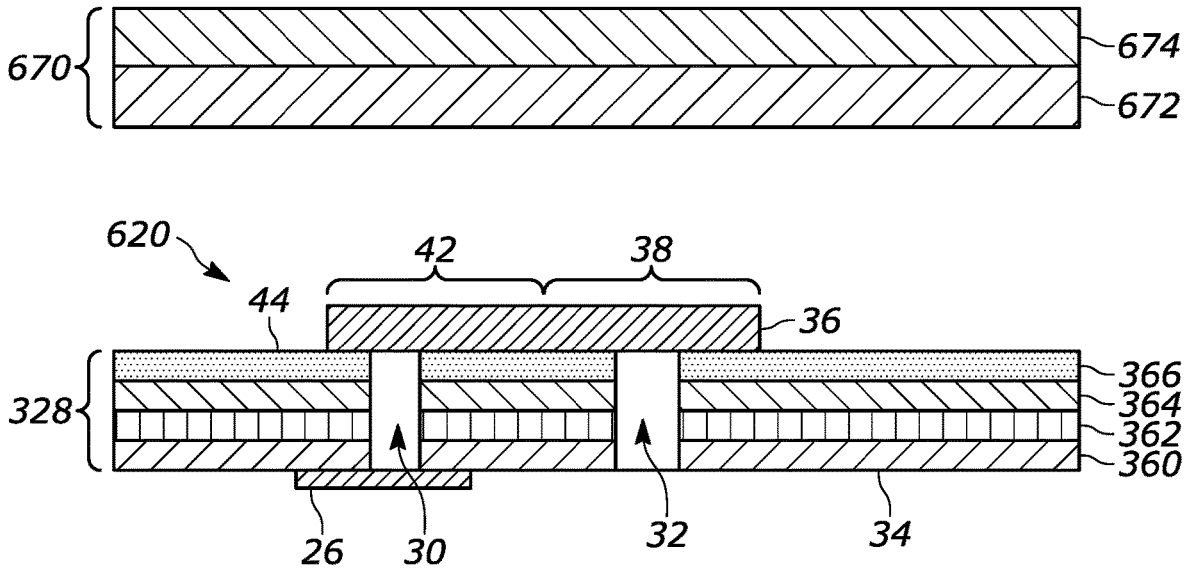
FIG. 15 is a cross-sectional view of a two-piece vented sealing member having a cap liner.

A two-piece configuration of a sealing member including a cap liner is shown in FIG. 15. Sealing member 620 includes support member 328 along with a cap liner 670. Cap liner 670 includes a wax layer 672 and a pulp layer 674. Cap liner 670 is temporarily bonded to the support member 328 and/or the upper member 36. Cap liner 670 may be configured to separate from the support member 328, such as during installation on a container. In this regard, when the sealing member 620 is heated during installation, the wax layer 672 may melt and potentially be absorbed by the pulp layer 674. Cap liner 670 is shown as being a multi-layer configuration, but it should be appreciated that it can include a single layer or multiple layers.

Figure 17:
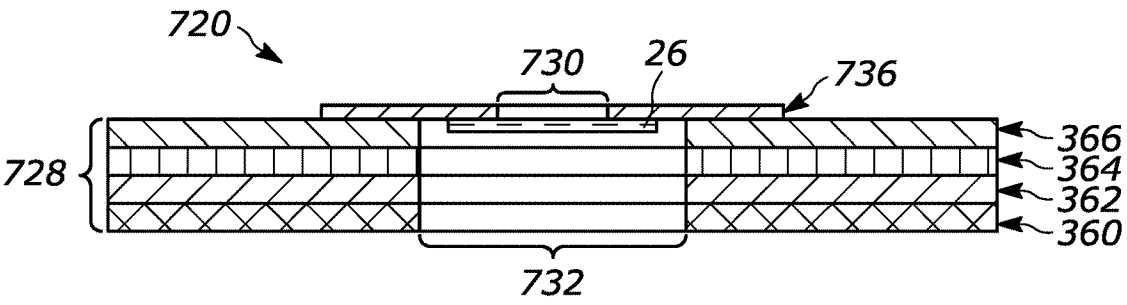
FIG. 17 is a cross-sectional view of the vented sealing member of FIG. 16 taken along line A-A.
Figure 16:
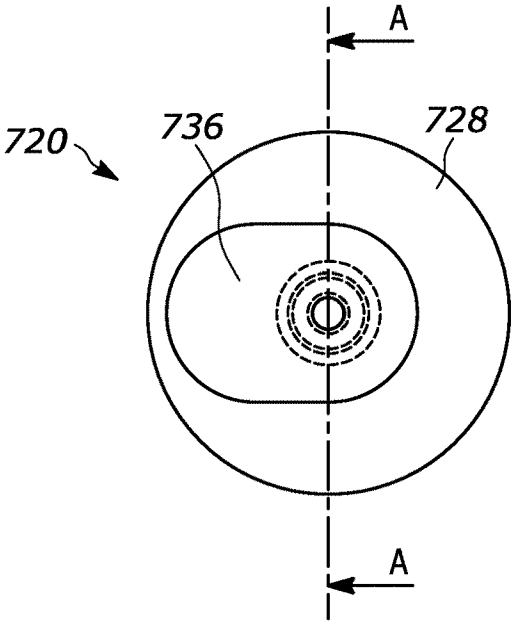
FIG. 16 is a top view of a vented sealing member.

A further form of a sealing member is shown in FIG. 16. In this form, sealing member 720 includes an upper member 736 and support member 728. The upper member 736 includes vent material 26 affixed thereto. FIG. 17 illustrates a cross-section of sealing member 720 taken along line A-A of FIG. 16. As shown in FIG. 17, dispensing opening 732 is in communication with vent opening 730. Instead of having each of dispensing opening 732 and vent opening 730 extending through the support member 728, only dispensing opening 732 extends therethrough with the vent opening 730 using dispensing opening 732 as a fluid passageway through the support member 728. Vent opening 730 is positioned through the upper member 736 with vent material 26 affixed to an underside of the upper member 736. In some forms, the vent material 26 is positioned within the dispensing opening 732, but not coupled to the dispensing opening 732 such that removal of the upper member 736 will also remove the vent material 26. When the upper member 736 is installed on the support member 728, fluid may be permitted to be exchanged through both the dispensing opening 732 as well as the vent opening 730. By having such a configuration, fewer openings may be needed in the support member 728, which can simplify manufacture, may permit for fewer locations for leaks, and other benefits.

Figure 19:
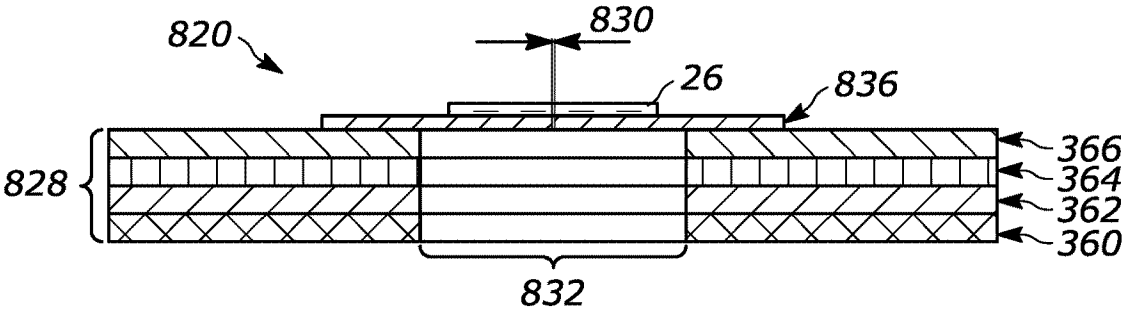
FIG. 19 is a cross-sectional view of the vented sealing member of FIG. 18 taken along line B-B.
Figure 18:
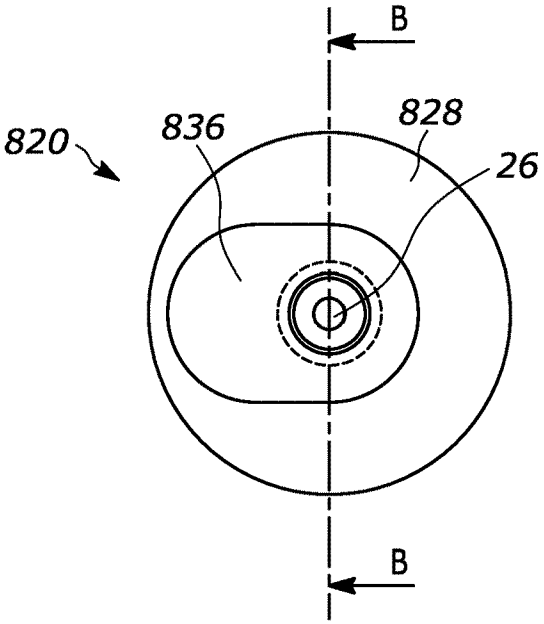
FIG. 18 is a top view is a top view of a vented sealing member.

A further form of sealing member is shown in FIGS. 18 and 19. Sealing member 820 is similar to sealing member 720 discussed above and includes an upper member 836 and support member 828. The upper member 836 includes vent material 26 affixed thereto. FIG. 19 illustrates a cross-section of sealing member 720 taken along line B-B of FIG. 18. As shown in FIG. 17, sealing member 820 includes vent material 26 positioned on an upper side of upper member 836. Upper member 836 includes vent opening 830, which is in fluid communication with dispensing opening 832. Similar to sealing member 720, Instead of having each of dispensing opening 832 and vent opening 830 extending through the support member 828, only dispensing opening 832 extends therethrough with the vent opening 830 using dispensing opening 832 as a fluid passageway through the support member 828. Vent opening 830 is positioned through the upper member 836 with vent material 26 affixed to an upper side of the upper member 736. When the upper member 736 is installed on the support member 728, fluid may be permitted to be exchanged through both the dispensing opening 732 as well as the vent opening 730.

While support members 728 and 828 are shown each having a variety of layers, such as sealant layer 360, induction layer 362, polymer foam layer 364, and polymer film layer 366, it should be appreciated that number, types, and relative positions of these layers may be modified as desired. For example, support members 728 and/or 828 may be provided such that it includes a sealant layer 360 and any one or more of the other layers discussed above.

Further, it should be appreciated that the vent openings, such as vent openings 730 and 830, as well as other vent openings described herein, may take a variety of sizes. When comparing vent openings 730 and 830, vent opening 730 may be larger than vent opening 830. This is because, in some instances depending on the contents of the container, the bottom of vent opening 830 may become obstructed. As described herein, a smaller vent opening may permit pressure differentials to be focused on smaller areas, thus increasing the chance that any blockages may be cleared.

The details of the layers and other structures are discussed in more detail below. As described above, each of the vent opening and dispensing opening extends from the lower surface to the upper surface of the support member. In this form, the vent opening provides a passageway for fluid, such as gas, air, and the like, to flow into and/or out of the container. The dispensing opening provides a pathway for the contents of the container to be dispensed when the upper member is removed.

The vent opening can be formed to have a variety of different sizes. When in the form of a generally circular cross-section, the vent opening can have a diameter of from about 0.005 to about 0.060 inches. In other forms, the vent opening can have a diameter of from about 0.005 to about 0.250 inches. It should be appreciated that depending on the method of forming the vent opening, the size and shape may not be perfectly symmetrical or perfectly follow the desired shape. For instance, the support member may include flexible material that stretches or shift during manufacture such that the vent opening may not have a perfect geometric shape. In this regard, it may be necessary to use a larger punch to create the vent opening than desired. When determining the vent opening size, the widest point of the opening may be used.

In some forms, the exposed area of the vent opening may be used to determine relative size of the opening. For example, the area of the vent opening may be about 0.00070 to about 0.0282 $in^2$. In some forms, larger vent openings may be used, depending on the choice of vent material, vent material size, and/or fluid properties of the contents of the container.

The vent opening can take a variety of shapes, sizes, forms, and the like. In some forms, the vent opening has a generally circular cross-section such that the vent opening is generally cylindrical. The vent opening can take other shapes and configurations, such as depending on how the vent opening is formed. Other shapes include, but are not limited to, square, rectangular, diamond, trapezoid, oval, round, and the like.

Similarly, the dispensing opening can be formed to have a variety of different sizes. When in the form of a generally circular cross-section, the dispensing opening can have a diameter of from about 0.0625 to about 0.5 inches. In other forms, the dispensing opening can have a diameter of from about 0.0625 to about 0.25 inches. However, the dispensing opening can be modified to have any desired opening size, such as depending on the contents to be dispensed. It should be appreciated that depending on the method of forming the dispensing opening, the size and shape may not be perfectly symmetrical or perfectly follow the desired shape. For instance, the support member may include flexible material that stretches or shift during manufacture such that the dispensing opening may not have a perfect geometric shape. In this regard, it may be necessary to use a larger punch to create the dispensing opening than desired. When determining the dispensing opening size, the widest point of the opening may be used.

In some forms, the exposed area of the dispensing opening may be used to determine relative size of the opening. For example, the area of the dispensing opening may be about 0.007 to about 0.050 $in^2$. In some forms, larger dispensing openings may be used, depending on the choice of vent material, vent material size, and/or fluid properties of the contents of the container.

The dispensing opening can take a variety of shapes, sizes, forms, and the like. In some forms, the dispensing opening has a generally circular cross-section such that the vent opening is generally cylindrical. The dispensing opening can take other shapes and configurations, such as depending on how the dispensing opening is formed. Other shapes include, but are not limited to, square, rectangular, diamond, trapezoid, oval, round, and the like. Similarly, multiple dispensing openings can be included. In these forms, the dispensing openings can be located near each other in a relatively small area. In some forms the dispensing openings can be located further apart.

Depending on the configuration of the sealant layer and the support member, the vent and dispensing openings may extend through the sealant layer and the support member. For example, when the sealant layer is configured to extend over the entire surface area of the lower surface of the support member, the vent and dispensing openings would be configured to also extend through the sealant layer. In other forms, such as when the sealant layer does not extend over the entire surface area of the lower surface, it may not be necessary to have the vent and dispensing openings extend through the sealant layer.

Further, the vent and dispensing openings may be configured in any orientation relative to the sealing member. For example, the vent and dispensing openings may be configured to extend substantially vertical (perpendicular to the lower and upper surfaces). In other forms, the vent and dispensing openings may be configured to extend at a different angle that is not vertical.

The vent and dispensing openings can be implemented in a variety of manners. For example, the vent and dispensing openings can be created by using a punch that creates the openings in the support member. The shape, size, angle, tip, and other properties of the punch may be modified to achieve the desired vent and dispensing openings shape and characteristics. Other methods may also be used, such as through a laser, hot tip lance, blade cutting, perforating, and the like.

As described above, the vent material can be in a form of a layer that that is positioned over the vent opening either on the upper and/or lower surface of the support member. The vent material can be a full layer or a partial layer, relative to the size and shape of the support member. In some forms, the vent material is a partial layer that is secured to the upper and/or lower surface of the support member about the vent opening. In some forms, the vent material may have a diameter of from about 0.19 inches to about 0.50 inches. In some forms, the vent material has a diameter of 3.2 mm, 4.8 mm, 6.4 mm, or 8.9 mm.

The vent material composition can include a variety of different materials to provide the desired venting function. The vent material may comprise a single layer, multiple layers, coatings, and the like. For example, in some forms, the vent material may have a base material, such as an ePTFE material that is then coated on at least one side thereof. In some forms, the vent may include a backing material or may be backless such that just ePTFE is provided.

The vent material choice may also be impacted by the contents of the container. For instance, certain liquids may be more suitable for use with certain types of vent materials. Such vent materials may include, but are not limited to, ePTFE materials, PVDF, nitro cellulose membranes, synthetic paper, and the like. Exemplary materials include, but are not limited to the following: 0.02 micron ePTFE—NW PET backer—oleophobic and hydrophobic coatings, 0.45 micron ePTFE—NW PET backer—oleophobic and hydrophobic coatings, 0.02 micron ePTFE—NW PP backer—oleophobic and hydrophobic coatings, 0.45 micron ePTFE—NW PP backer—oleophobic and hydrophobic coatings, 0.7 micron ePTFE—NW PP backer—oleophobic and hydrophobic coatings, 0.02 micron ePTFE—NW PP/PET backer—oleophobic and hydrophobic coatings, 0.45 micron ePTFE—NW PP/PET backer—oleophobic and hydrophobic coatings, 0.7 micron ePTFE—Delnet backer—oleophobic and hydrophobic coatings, 0.05 micron ePTFE—NW PET backer—oleophobic and hydrophobic coatings, 0.05 micron ePTFE—NW PP backer—oleophobic and hydrophobic coatings, and the like. Other backless forms may also be used.

The vent material may be installed in a variety of different manners, for example, depending on the vent material as well as the surfaces of the support member, the vent material may be installed by ultrasonic welding, adhesives, heat staking, and the like. It should be appreciated that in some forms, the backer and support layers are used to secure the vent material to the support member. Further, this permits the vent material to be secured directly to the liner compared to prior vents where the vent material is adhered to a lower silicon layer below the support member with the silicon layer being used to secure the vent material to the lower side of the sealing member. However, silicon layers may also be used.

In some forms, the vent material is installed, such as by welding, so that there are no gaps in the contact between the vent material and the support member to prevent gas from escaping anywhere except through the vent material. It should be appreciated that the surface area of the vent material may be varied along with the surface exposure or diameter of the vent opening. The vent material 26 may also be secured at a peripheral edge thereof or at a location closer to the vent opening.

The vent opening and vent material may be combined and modified to achieve suitable venting and clearing of the vent material and vent opening. For example, for vents with an effective filter area of 0.125" for the filter material, the vent opening can include a vent opening of 0.0413" or smaller, but some may include vent openings with sizes up to 0.100". For intermediate vent material layers with effective filter area of 0.160" the vent opening may have a size of 0.528" (⅓), with decreasing performance up to a hole size of 0.128". It should be appreciated that, in some forms, the data does trend towards smaller ratios having a bigger advantage with thicker liquids.

In some forms, it may be preferable to have our hole size less than 30% of the vent material effective filter area, but with the understanding there are still some significant advantages to vent opening sizes all the way up to 80% or more of the vent's effective filter area. Smaller hole size to vent ratios tend to perform equally or better to this point.

The sealant layer may be selected from a variety of different sealing materials. For example, the sealant layer may be a heat activated bonding layer. In this form, the sealant layer may be heated through induction, conduction, and the like. The sealant layer may also take other forms such as pressure sensitive adhesive and the like.

One exemplary form of a vented sealing member includes about 0.015 inch thick heat seal, 0.0005 inch thick PET layer on the heat seal, a 0.001 inch thick aluminum foil layer on the PET, 0.007 inch thick polymer foam material on the aluminum foil layer, and an ePTFE vent material adhered to one of the upper and lower surfaces. The vent opening is 0.105 inches and the dispensing opening is 0.097 inches. The polymer foam material may be thicker and may include a coextruded film to increase the thickness.

Another exemplary vented sealing member is similar to the above, but includes the ePTFE vent material adhered directly to the foil material without intermediary polymer foam layer. In this form, the vent material can be applied by adhering to a polymer film layer, such as PET.

In some forms, it may be desirable to have the vent material applied PET, PP, or PE film layer, such as on the upper surface of the support member. Depending on the installation technique it may be desirable to have a somewhat thicker upper surface, such as about 0.001 to about 0.020 inches thick. This allows for a proper weld of the vent material to the liner. In some forms, depending on the particular upper surface material, a layer of 0.0005 inches was too thin and welding the vent material would melt through and create small pinholes within the weld allowing for product to pass through the vent material at the weld. By using a slightly thicker upper surface layer, a much wider process window can be utilized for welding and production speeds improved. The quality of the weld also improved.

In some forms, it may be difficult to determine if the vent material is properly applied to the support member and is properly positioned over the vent opening. For example, when white vent material is applied to white support member, it may be difficult to automate quality control. In this regard, one or more of the upper surface of the support layer and the vent material may include a color, printing, and the like, as described below.

When the upper surface of the support member is white, the white color prevents some inspection systems from seeing the weld of the vent material on the surface of the support member. The inspection system visually inspects every vent during the manufacturing process and confirms vent placement, weld integrity, and proper cut of vent material. When the vent material is also white, the inspection system image did not have enough contrast to confirm the key features.

To overcome this issue, printed liners were attempted to provide some contrast. This provided an improvement in contrast and it was found that when the vents lined up with the lettering on the liner our camera could see the vent and performed the inspections. The use of a colorant in the PET layer was also utilized to provide the needed contrast. This provided needed contrast for visual inspections.

It should be appreciated that the combination of the small vent hole and ePTFE vent material facing away from the product in the container allows for thick viscous products to be cleared from the vent hole and ePTFE vent material when pressure returns into the sealed package. The vent layer prevents product from escaping and allows for sterile air to return into the container. In some forms, the present concept proceeds contrary to conventional wisdom by maintaining a small opening and positioning the vent material on an opposite side of the liner. As noted above, conventional wisdom would have increased the surface area of the vent material exposed to the contents of the container. Instead, by having a focused and small area, the pressure is able to direct liquids from the vent material and away from the vent opening.

As noted above, the concepts described herein may be especially suitable with applications where the product is thick and viscous. Typically, products like this will coat the vent material and prevent pressure equalization. Such products are often hot filled and when the product cools within the sealed container, the pressure within the container will drop causing the container to panel. Exemplary materials include, but are not limited to, motor oil, hair conditioner, shampoo, car wax, laundry detergents, liquid soap, nail polish cleaner, industrial cleaning products, pet foods, floor cleaner/wax, hand/body lotions, and the like.

It should be appreciated that the layers in the support member and the sealant layer can be selected to work with a variety of different containers. For example, containers made from HDPE, PET, glass, LDPE, nylon, pulp board, acrylic, metal, phenolic, and the like may be used.

The upper member, such as including the tab, may be made from one or more different materials and may include one or more layers. Further, the upper member may have a variety of different shapes and sizes and may be positioned at various locations on the sealing member. In some forms, the upper member includes polymer film, polymer foam, and the like. In some forms, the sealing member generally provides a hermetic seal. In some forms, the sealing member includes at least one layer that has a very low oxygen transmission rate. In one form, the upper member is attached to the support member using a heat-steaking process allowing for a leak proof seal. In some forms, the upper member could be made of alternative materials for example a flexible film attached to the support member using an adhesive rather than heat staking.

It should be appreciated that the number and type of layers can be modified as discussed above. Further, in some forms, the support members may include a single layer, two layers, three layers, four layers, five layers, etc. For example, the support member may include an induction heating layer, such as a metal foil layer, and a polymer film and/or polymer foam layer. In this regard, the induction heating layer can be used in an induction process to provide heat to the sealant layer and the polymer film and/or polymer foam layer can be used as a surface for installing the vent material. In other forms, only a polymer film and/or polymer foam layer may be used without the induction heating layer.

As noted above, the dispensing opening could have another material integrated over it that could be a hydrophilic material or screen which could aid in the aerosolization of the product when forced from the container by the consumer. The screen may take a variety of shapes, forms, configurations, and the like. Exemplary materials include, but are not limited to ePTFE, hydrophilic materials, PVDF, polypropylene films, Delnet screens, nylon screens, and the like.

Additional layers may be included in the upper (tabbed member) and/or lower laminate (support member) such as polyethylene terephthalate (PET), nylon, or other structural polymer layer and may be, in some approaches, about 0.5 to about 1 mil thick. In some approaches, additional layers may be included in the lower laminate. It should be appreciated that the lower seal laminate may include any number of other layers, such as polymer layers, adhesives, polymer films, polymer foams and the like.

The lower sealant or heat seal layer may be composed of any material suitable for bonding to the rim of a container, such as, but not limited to, induction, conduction, or direct bonding methods.

The polymer layers used in the upper and/or lower laminates may take a variety of forms such as coatings, films, foams, and the like. Suitable polymers include but are not limited to, polyethylene, polypropylene, ethylene-propylene copolymers, blends thereof as well as copolymers or blends with higher alpha-olefins. By one approach, one or more of the polymer layers may be a blend of polyolefin materials, such as a blend of one or more high density polyolefin components combined with one or more lower density polyolefin components. In one form, one polymer layer may be a polyethylene film while another polymer layer may be a PET film. According to one form, the polyethylene film may have a thickness of about 5 to about 20 microns while the PET film may have a thickness of about 5 to about 20 microns.

A further support layer may be optional in the upper member or support member. If included, it may be polyethylene terephthalate (PET), nylon, or other structural polymer layer and may be, in some approaches, about 0.5 to about 1 mil thick.

The membrane layer may be one or more layers configured to provide induction heating and/or barrier characteristics to the seal. A layer configured to provide induction heating is any layer capable of generating heat upon being exposed to an induction current where eddy currents in the layer generate heat. By one approach, the membrane layer may be a metal layer, such as, aluminum foil, tin, and the like. In other approaches, the membrane layer may be a polymer layer in combination with an induction heating layer. The membrane layer may also be or include an atmospheric barrier layer capable of retarding the migration of gases and moisture at least from outside to inside a sealed container and, in some cases, also provide induction heating at the same time. Thus, the membrane layer may be one or more layers configured to provide such functionalities. By one approach, the membrane layer is about 0.3 to about 2 mils of a metal foil, such as aluminum foil, which is capable of providing induction heating and to function as an atmospheric barrier.

In some forms, the seals may include an insulation layer or a heat-redistribution layer. In one form, the insulation layer may be a foamed polymer layer. Suitable foamed polymers include foamed polyolefin, foamed polypropylene, foamed polyethylene, and polyester foams. In some forms, these foams generally have an internal rupture strength of about 2000 to about 3500 g/in. In some approaches, the foamed polymer layer 106 may also have a density less than 0.6 g/cc and, in some cases, about 0.4 to less than about 0.6 g/cc. In other approaches, the density may be from about 0.4 g/cc to about 0.9 g/cc. The foamed polymer layer may be about 1 to about 5 mils thick.

In other approaches, a non-foam heat distributing or heat re-distributing layer may be included. In such approach, the non-foam heat distributing film layer is a blend of polyolefin materials, such as a blend of one or more high density polyolefin components combined with one or more lower density polyolefin components. Suitable polymers include but are not limited to, polyethylene, polypropylene, ethylene-propylene copolymers, blends thereof as well as copolymers or blends with higher alpha-olefins. By one approach, the non-foam heat distributing polyolefin film layer is a blend of about 50 to about 70 percent of one or more high density polyolefin materials with the remainder being one or more lower density polyolefin materials. The blend is selected to achieve effective densities to provide both heat sealing to the container as well as separation of the liner from the seal in one piece.

The heat-activated bonding layer may include any polymer materials that are heat activated or heated to achieve its bonding characteristics or application to the seal. By one approach, the heat-activated bonding layer may have a density of about 0.9 to about 1.0 g/cc and a peak melting point of about 145° F. to about 155° F. A melt index of the bonding layer 120 may be about 20 to about 30 g/10 min. (ASTM D1238). Suitable examples include ethylene vinyl acetate (EVA), polyolefin, 2-component polyurethane, ethylene acrylic acid copolymers, curable two-part urethane adhesives, epoxy adhesives, ethylene methacrylate copolymers and the like bonding materials.

The adhesives useful for any of the adhesive or tie layers described herein include, for example, ethylene vinyl acetate (EVA), polyolefins, 2-component polyurethane, ethylene acrylic acid copolymers, curable two-part urethane adhesives, epoxy adhesives, ethylene methacrylate copolymers and the like bonding materials. Other suitable materials may include low density polyethylene, ethylene-acrylic acid copolymers, and ethylene methacrylate copolymers. By one approach, any optional adhesive layers may be a coated polyolefin adhesive layer. If needed, such adhesive layers may be a coating of about 0.2 to about a 0.5 mil (or less) adhesive, such as coated ethylene vinyl acetate (EVA), polyolefins, 2-component polyurethane, ethylene acrylic acid copolymers, curable two-part urethane adhesives, epoxy adhesives, ethylene methacrylate copolymers and the like bonding materials.

In one aspect, the tab may be formed by a partial layer of material combined with a partial width composite adhesive structure that includes a polyester core with upper and lower adhesives on opposite sides thereof. This partial composite adhesive structure bonds the upper laminate to the lower laminate to form the gripping tab.

In other aspects of this disclosure, the upper portion of the seal does not extend the full width of the sealing member in order to define the gripping tab. To this end, the pull-tab sealing members herein may also combine the advantages of a tabbed sealing member with a large gripping tab defined completely within the perimeter of the seal, but achieve such functionality with less material (in view of the part layers of the upper laminate) and permit such a tab structure to be formed on many different types of pre-formed lower laminates. The partial upper laminate structure is advantageous, in some approaches, for use with a seal configured for large or wide mouth containers, such as containers with an opening from about 30 to about 100 mm (in other approaches, about 60 to about 100 mm). These seals may also be used with 38 mm or 83 mm container openings, or can be used with any sized container.

In further aspects of this disclosure, the sealing members herein may include a pull or grip tab defined in the upper portion wholly within a perimeter or circumference of the sealing member wherein an upper surface of the sealing member is partially defined by the upper portion and partially defined by the lower laminate portion. In one approach of this aspect, the top surface of the sealing member is provided by a minor portion of the upper laminate and a major portion of the lower laminate. In other approaches of this aspect, the lower laminate is partially exposed at a top surface of the seal with about 50 percent to about 75 percent (or more) of the lower laminate exposed at the top surface of the entire seal.

In the various embodiments, the seals of the present disclosure defining a tab wholly within a perimeter or circumference of the seal (formed by a full or partial layer) also provide an improved ability for the tabbed sealing member to function in a two-piece seal and liner combination. In a two-piece seal and liner combination, the tabbed sealing member is temporarily adhered across its top surface to a liner. After container opening and removal of a cap or closure, the sealing member stays adhered to the container mouth and the liner separates and remains in the container's cap.

In some versions of two-piece seal and liner assemblies, the bottom layer of the sealing member is a heat seal layer that is activated by heating, such as by induction or conduction heating, in order to adhere or bond an outer periphery of the sealing member to a rim surrounding the mouth of a container. In the two-piece seal and liner combination, an upper surface of the sealing member is temporarily adhered to a lower surface of the liner by a release layer, which is often a heat-activated release layer, such as an intervening wax layer. During heating to bond the sealing member to the container, heat not only activates the lower heat seal layer, but also travels upwardly through the seal to melt the intervening wax across the entire surface of the sealing member to separate the liner from the sealing member. Often, the melted wax is absorbed by the liner in order to permit easy liner separation from the sealing member. As can be appreciated, for this sealing member and liner combination to function properly, the intervening wax layer needs to be melted across the entire surface of the sealing member. If the wax is not melted evenly all the way across the sealing member upper surface, the liner may not properly separate from the lower seal portion.

The various layers of the sealing member are assembled via coating adhesives, applying films, and/or a heat lamination process forming a sheet of the described layers. Extrusion lamination may also be used. The resulting laminate sheet of the sealing members can be cut into appropriately sized disks or other shapes as needed to form a vessel closing assembly or tabbed sealing member. The cut sealing member is inserted into a cap or other closure which, in turn, is applied to the neck of a container to be sealed. The screw cap can be screwed onto the open neck of the container, thus sandwiching the sealing member between the open neck of the container and the top of the cap. The sealing layer may be a pressure sensitive adhesive, the force of attaching the closure to the container can activate the adhesive.

The vented sealing members may be manufactured in a variety of different manners. In one form, the support member, typically also including the sealant layer, is provided to have the vent opening and the dispensing opening formed therein. As noted above, the support member can be worked by a punch, laser, and the like to create the vent opening extending therethrough. Once the vent opening has been created, the vent material can be applied to the support member at the vent opening. This can be done by welding, direct contact adhesives, pressure sensitive adhesives, thermal lamination, and the like. After the dispensing opening is formed, the upper member may be added.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. A vented sealing member for sealing to a rim of a container, the vented sealing member comprising:

a support member having at least one layer, the support member defining a vent opening and a dispensing opening, each of the vent opening and dispensing opening extending from a lower surface to an upper surface of the support member;

a vent layer positioned about the vent opening on at least one of the lower surface and the upper surface, the vent layer permitting gas to vent therethrough; and an upper member positioned at the upper surface of the support member and partially coupled thereto to provide a coupled portion and a free portion forming a gripping tab for separating the upper member from the support member, the coupled portion covering the dispensing opening at the upper surface of the support member.

2. The vented sealing member of claim 1 wherein the vent layer is coupled to the upper surface of the support member.

3. The vented sealing member of claim 1 wherein the vent layer is coupled to the lower surface of the support member.

4. The vented sealing member of claim 1 wherein the support member is a laminate comprising a plurality of layers.

5. The vented sealing member of claim 1 wherein the support member comprises at least one of a polymer film, a polymer foam, a metal foil, a pulp material, paper, and combinations thereof.

6. The vented sealing member of claim 1 wherein the vent opening has a diameter of about 0.005 to about 0.250 inches.

7. The vented sealing member of claim 1 wherein the dispensing opening has a diameter of about 0.0625 to about 0.5 inches.

8. The vented sealing member of claim 1 further comprising a screen covering the dispensing opening.

9. The vented sealing member of claim 1 wherein the vented sealing member includes an entire surface area and the upper member extends across the entire surface area.

10. The vented sealing member of claim 1 wherein the vented sealing member includes an entire surface area and the upper member extends across less than the entire surface area.

11. A laminate for forming a vented sealing member for sealing to a rim of a container, the laminate comprising:

a support member having at least one layer, the support member defining a vent opening and a dispensing opening, each of the vent opening and dispensing opening extending from a lower surface to an upper surface of the support member;

a vent layer positioned about the vent opening on at least one of the lower surface and the upper surface, the vent layer permitting gas to vent therethrough; and an upper member positioned at the upper surface of the support member and partially coupled thereto to provide a coupled portion and a free portion forming a gripping tab for separating the upper member from the support member, the coupled portion covering the dispensing opening at the upper surface of the support member.

12. The laminate of claim 11 wherein the vent layer is coupled to the upper surface of the support member.

13. The laminate of claim 11 wherein the vent layer is coupled to the lower surface of the support member.

14. The laminate of claim 11 wherein the support member is a laminate comprising a plurality of layers.

15. The laminate of claim 11 wherein the support member comprises at least one of a polymer film, a polymer foam, a metal foil, a pulp material, paper, and combinations thereof.

16. The laminate of claim 11 wherein the vent opening has a diameter of about 0.005 to about 0.250 inches.

17. The laminate of claim 11 wherein the dispensing opening has a diameter of about 0.0625 to about 0.5 inches.

18. The laminate of claim 11 further comprising a screen covering the dispensing opening.

* * * * *